United States Patent [19]

Stock

[11] 4,334,638

[45] Jun. 15, 1982

[54] CHILD PROOF DISPENSER

[75] Inventor: Hugh J. Stock, Saratoga, Calif.

[73] Assignee: Pacer Technology and Resources, Inc., Campbell, Calif.

[21] Appl. No.: 119,635

[22] Filed: Feb. 7, 1980

[51] Int. Cl.[3] ..... B67B 5/00; B67D 5/32; B65D 55/02

[52] U.S. Cl. ..... 222/153; 222/182; 222/541; 222/545; 215/216

[58] Field of Search ..... 222/153, 182, 545, 541; 215/216, 218–225, 209

[56] References Cited

U.S. PATENT DOCUMENTS

| | | | |
|---|---|---|---|
| 3,612,323 | 10/1971 | Mauck | 215/216 X |
| 3,826,395 | 7/1974 | Montgomery | 215/221 |
| 3,858,739 | 1/1975 | Turner et al. | 222/541 X |
| 4,071,156 | 1/1978 | Lowe | 215/224 |
| 4,134,513 | 1/1979 | Mumford | 215/216 |
| 4,220,247 | 9/1980 | Kramer | 222/153 X |

FOREIGN PATENT DOCUMENTS

| | | | |
|---|---|---|---|
| 2828093 | 1/1979 | Fed. Rep. of Germany | 215/216 |
| 613907 | 10/1979 | Switzerland | 215/224 |
| 1387572 | 3/1975 | United Kingdom | 215/216 |

*Primary Examiner*—Charles A. Marmor
*Attorney, Agent, or Firm*—Cahill, Sutton & Thomas

[57] ABSTRACT

A two phase interlock secures a cap to a container of a fluid. The interlock includes flanges extending from the cap for engaging lugs located about the mouth of the container which flanges are disengageably engagable with the lugs by rotating the cap relative to the container and a key extends from the cap into a key way in the container to prevent rotation of the cap relative to the container without withdrawal of the key from the keyway by deliberate precise flexing of the cap.

12 Claims, 9 Drawing Figures

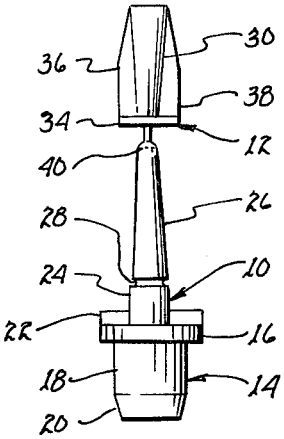
fig. 1
fig. 2
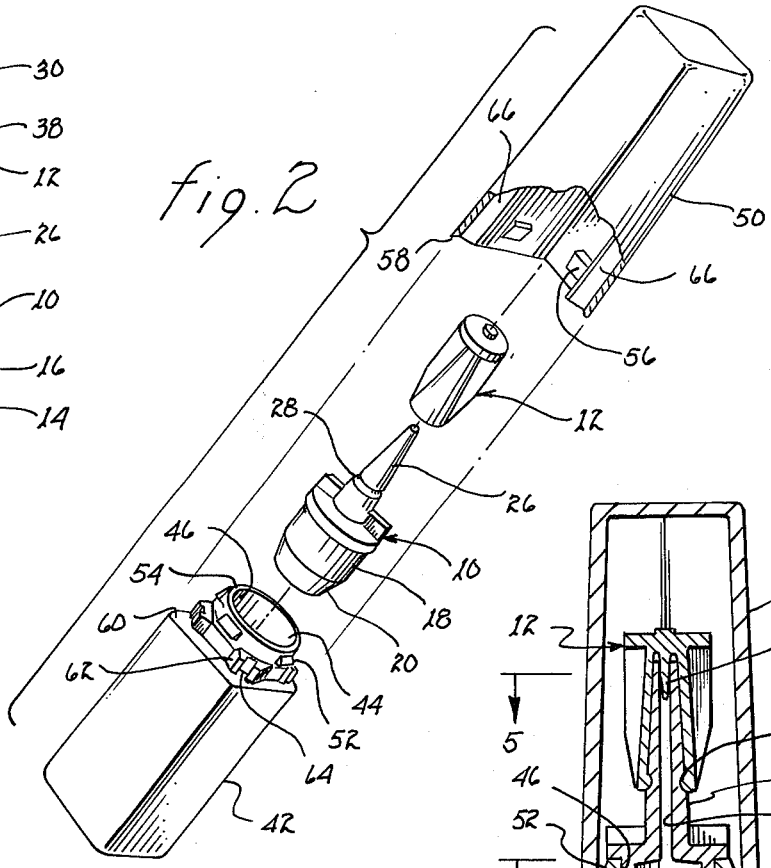
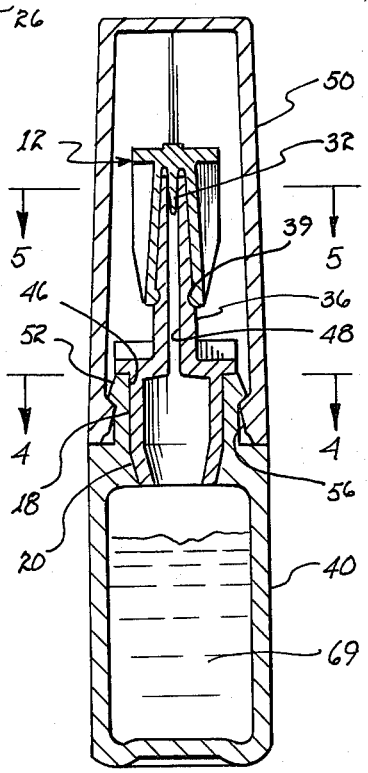
fig. 3
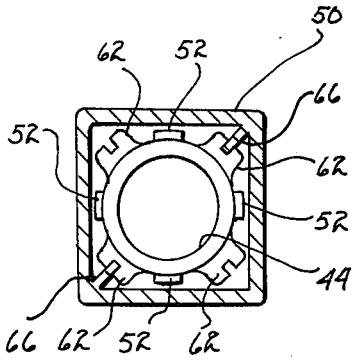
fig. 4
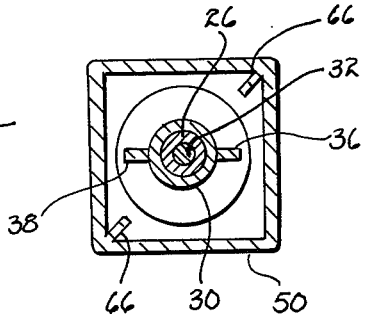
fig. 5

CHILD PROOF DISPENSER

The present invention relates to child proof dispensers and, more particularly, to interlocks for securing a cap to a container.

As a result of federal regulations, variously locked caps for containers have been developed to prevent inadvertent ingestion by a child of the container contents. Wide mouthed pill containers often incorporate a cap which is rotatably mounted and removable only upon alignment of an index on the cap with a corresponding index on the container. Upon such alignment, the cap may be pried off with relative ease. With screw on caps, a locking detented mechanism is often used which requires simultaneous depressing and rotating of the cap for the cap to become in threaded engagement with the container and removable therefrom. Various adaptations of mechanisms which require the above described simultaneous dual repositioning of the cap relative to the container have been developed. All of them however, require a certain degree of looseness in fit of the cap when the cap is lockingly in place. Moreover, the above described caps are primarily used with wide mouth containers for pills and like medications.

It is therefore a primary object of the present invention to provide a liquid dispenser having a sequentially operated dual lock mechanism for securing the cap to the container.

Another object of the present invention is to provide a sequentially operated two phase lock for lockingly securing a cap with its container.

Yet another object of the present invention is to provide a dual lock for securing a cap to a container, which lock requires two sequential and physically distinct movements of the cap relative to the container.

Still another object of the present invention is to provide a cap lockingly secured to a container by a first lock precluding rotation therebetween and a second lock precluding nonrotational movement therebetween.

A futher object of the present invention is to provide a cap releaseable from a container by initial flexing of the cap to permit rotation thereof relative to the container, which rotation releases locking engagement therebetween.

A yet further object of the present invention is to provide a stopper for a cyanoacrylate dispensing tip which promotes evacuation of the passageway within the tip upon mounting of the stopper.

A still futher object of the present invention is to provide a stopper for a fluid dispensing tip which is positionably releasably locked to the tip by an internal annular ridge of the stopper engaging an annular groove about the tip.

A still further object of the present invention is to provide a continuous uniform diameter passageway within a dispensing tip for dispensing cyanoacrylate, which passageway discourages crusting of the cyanoacrylate within the passageway.

These and other objects of the present invention will become apparent to those skilled in the art as the description thereof proceeds.

The present invention may be described with greater specificity and clarity with respect to the following drawings, in which:

FIG. 1 is a side view of a dispensing tip and stopper molded as a unit and prior to separation and attachment of same to a container;

FIG. 2 is an isometric view of the components of a cyanoacrylate dispenser having a lockably attached cap;

FIG. 3 is a cross-sectional view of the dispenser;

FIG. 4 is a cross-sectional view taken along lines 4—4, as shown in FIG. 3;

FIG. 5 is a cross-sectional view taken along lines 5—5, as shown in FIG. 3;

Figure 6:
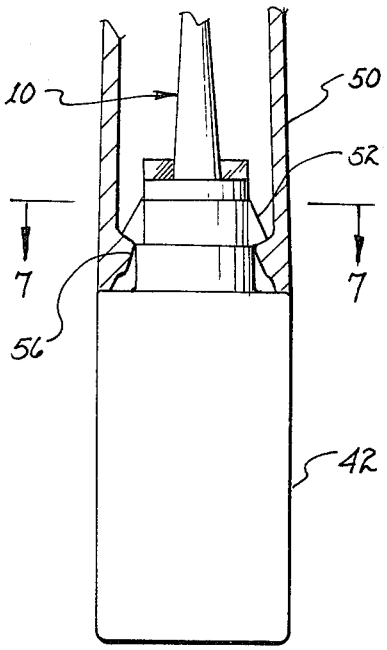
FIG. 6 is a partial cross-sectional view illustrating one part of the two part lock securing the cap to the container.
Figure 7:
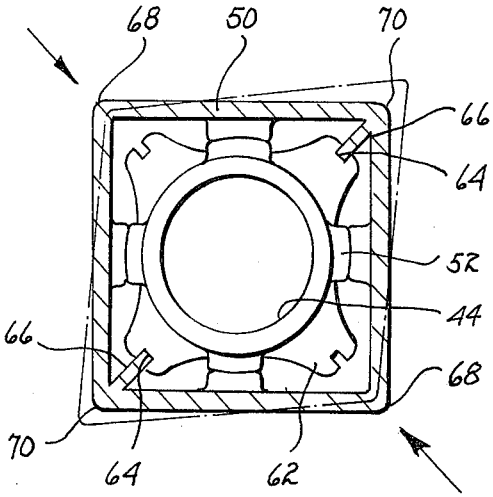
FIG. 7 is a cross-sectional view taken along lines 7—7, as shown in FIG. 6.
Figure 8:
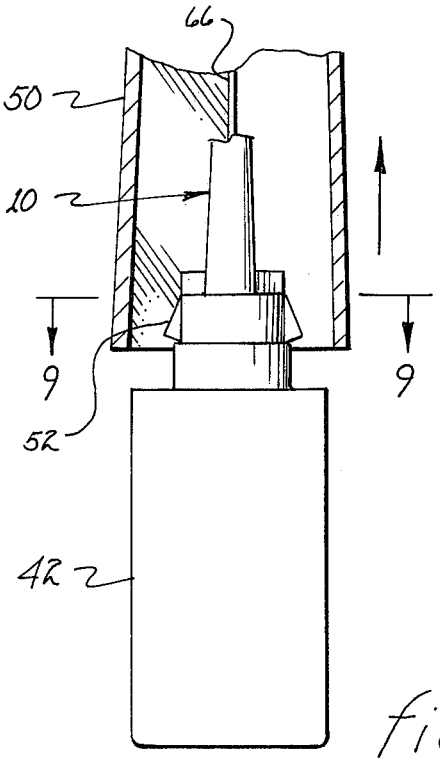
FIG. 8 illustrates the unlocked disengagement upon relative rotation between the cap and the container.

FIG. 1 illustrates a dispenser tip 10 and a stopper 12 molded as a single unit and severable from one another prior to attachment to a container. The dispenser tip includes a hollow boss 14 extending downwardly from a disc section 16, which boss includes a constant diameter cylindrical section 18 and a radially inwardly tapered section 20. A diametrically oriented flange 22 upwardly extending provides structural support intermediate base 24 of tip 26 and disc section 16. Tip 26 is tapered and includes an annular groove 28 disposed in proximity to base 24.

Stopper 12 is formed by a hollow coned shaped section 30 for mating with tip 26. A plug 32 extends from the tip interior of the cone shaped section. A disc 34 is disposed in proximity to the apex of cone shaped section 30 and flanges 36 and 38 extend therefrom to the exterior surface of the cone shaped section to provide structural rigidity to stopper 12. In proximity to the interior base of cone shaped section 30, there is disposed an inwardly oriented annular ridge 39 dimensioned to grippingly mate with groove 28 of tip 26. The groove and ridge serve in the nature of detent means to maintain the stopper upon the tip.

After molding, dispenser tip 10 and stopper 20 are severed from one another by a cut made along dashed line 40. Such a cut exposes a constant diameter passageway 48 (see FIG. 3) extending through tip 26 and defines the outlet of the passageway. For reasons which will be described in further detail below, plug 32 of stopper 20 extends into the outlet of the passageway and mates with the passageway on attachment of the stopper to the tip unit.

The major component parts of a dispenser constructed in accordance with teachings of the present invention are shown in FIG. 2. A container 42 for the fluid to be dispensed, such as cyanoacrylate, includes a mouth 44 defined by an internal cylindrical surface 46 of cylindrical section 54 extending from shoulder 60. The diameter of the cylindrical surface 46 is the same as or somewhat less than the diameter of cylindrical section 18 of dispenser tip 10 to insure a tight friction or force fit therebetween; tapered section 20 aids in insertion of the cylindrical section within the cylindrical surface.

Stopper 12 engages tip 26 which engagement, brings about insertion of plug 32 within passageway 48 in the tip and mating of the ridge in the stopper with groove 28 of the tip.

A cap 50 encloses dispenser tip 10 and its attached stopper 12 upon engagement of the locking mechanisms disposed in the cap with the locking mechanism disposed about cylindrical section 54.

The elements of the locking mechanisms intermediate cap 50 and container 42 will be described with joint reference to FIGS. 2, 3, 4 and 5. Four lugs 52 are equiangularly disposed about the surface of cylindrical section 54. These lugs are shaped in a nature of downwardly oriented louvers, as illustrated. Cap 50 includes four flanges 56 extending inwardly from the inner walls of the cap and positionally correspond with lugs 52 to obtain a mating interlock therebetween on positioning of bottom edge 58 of the cap with shoulder 60 of the container. These flanges are upwardly oriented louver-like elements, as illustrated.

In cross-section, cap 50 is square and lower edge 58 is dimensioned generally commensurate with the square cross-sectional configuration of container 42. Abutments 62 are disposed proximate each corner edge of container 42 and extend upwardly from shoulder 60. Each of these abutments define a channel 64 extending upwardly from shoulder 60 and in radial alignment with cylindrical section 54. Cap 50 includes, in two opposed corners, inwardly extending ribs 66. These ribs are dimensioned in width and breadth to engage diametrically opposed ones of channels 64 on poitioning of cap 50 upon container 42 when bottom edge 58 is adjacent shoulder 60. As noted in FIG. 5, the ribs are configured not to interfere with disc 34 of stopper 12.

Figure 9:
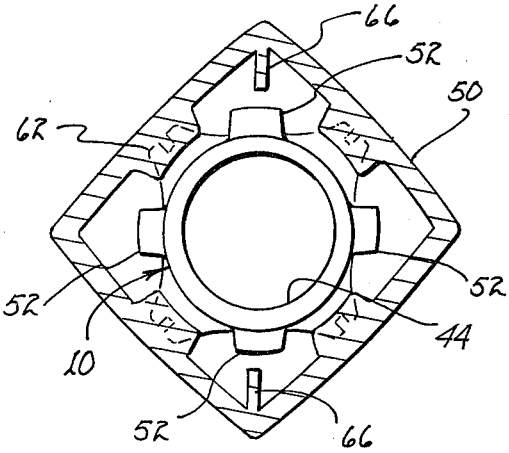
FIG. 9 is a cross-sectional view taken along lines 9—9, as shown in FIG. 8.

Attachment and detachment of cap 50 with container 42 will be described in reference to FIGS. 6, 7, 8 and 9. To detach the cap from the container, diametrically opposed corners 68 of the cap, which corners do not include ribs 66, are squeezed together. The resulting flexing of cap 50 causes diametrically opposed corners 70 to be laterally displaced from one another. The resulting displacement withdraws ribs 66 from there mating channels 64. On disengagement the constraints intermediate the cap and container relative to rotation therebetween are removed. Simultaneous with the squeezing of corners 68 and after disengagement of the ribs, cap 50 is rotated relative to container 42 about the longitudinal axis of the cap and container. Such rotation will result in angular displacement of flanges 56 relative to lugs 52 and is continued until the flanges are no longer in contacting relationship with the respective lugs. This position is illustrated in FIG. 9. The cap may now be removed from container 42.

Assembly of cap 50 with container 42 is a reverse implementation of the above described operation. That is, cap 50 is placed upon container 42 such that flanges 56 are in general alignment with abutments 62; thereafter, the cap is rotated about its longitudinal axis relative to the container until the flanges slidably engage and interlock with lugs 52. Simultaneously, the corners 68 of the cap are squeezed toward one another to allow clearance between ribs 66 and the pertaining ones of abutments 62. Upon sufficient rotation of the cap with respect to the body to align the corner edges of the cap with the corner edges of the container, ribs 66 will become aligned with channels 64 and the cap may be released. At this point, rotation of the cap with respect to the container is constrained by the mating of ribs 66 with channels 64 in the abutments; vertical displacement of the cap with respect to the container is prevented by the interlocking relationship between lugs 52 and flanges 56.

From the above description it will become apparent that edge 58 of the cap may be force fit against shoulder 60 by appropriate location of lugs 52 and/or flanges 56 to rigidly retain the cap. Moreover, the tightness of fit between the cap and the container has no effect upon leakage as stopper 12 is employed to seal the dispensing tip passageway.

By experimentation, it has been learned that when container 42 is used to store and dispense cyanoacrylate 69 (see FIG. 3), passageway 48 within tip 26 will drain of cyanoacrylate on placement of the container in the upright position provided that the passageway is of constant diameter. Were it cone shaped, as is common with most fluid dispensing tips, crusting of the cyanoacrylate will occur within the passageway and the passageway will quickly become clogged. Moreover, it has been learned that when a stopper is incorporated which includes a plug 32, the resulting pressure within passageway 48 upon engagement of the plug, will result in essentially complete draining of the cyanoacrylate from within the passageway. The total and complete understanding of the mechanical and fluid dynamics involved is not presently known. Nevertheless, the results are known and the above described construction of dispenser tip 10 and stopper 12 are capable of providing the sought results.

The extensive contact area between hollow boss 14 and the underside radial surface of disc section 16 with corresponding surfaces of container 42 tends to ensure a total seal between the dispenser tip and the container, despite variations in manufacturing tolerances and possible deformation of the mating surfaces due to scratches, etc. Moreover, by maintaining dimensions of cylindrical section 18 at least equal to the dimensions of the corresponding cylindrical surface within the container, a friction fit is obtained and by appropriate selection of plastic compositions, a continuing pressure gradient therebetween will exist to insure an adequate seal against leakage.

While the principles of the invention have now been made clear in a described and illustrated embodiment, there will be immediately obvious to those skilled in the art many modifications of structure, arrangement, proportions, elements, materials and components useable in the practice of the invention which are particularly adapted for specific environments and operating requirements without departing from these principles.

I claim:

1. A two phase lock for securing a cap to the hollow neck section of a container, said lock comprising in combination:

(a) lug means disposed about the hollow neck section of the container, said lug means being located upon and extending radially outwardly of the exterior surface of the hollow neck section;

(b) a flexible side wall formed as part of the cap for circumscribing the hollow neck section of the container;

(c) flange means disposed within said side wall for disengageably engaging said lug means upon angular displacement of the cap relative to the container, said flange means being located upon and extending radially inwardly of said side wall and positionally disposed upon said side wall to urge the lower edge of the cap against a shoulder of the container extending about the hollow neck section and impart a compressive force to the portion of the cap intermediate said flange means and the lower edge of the cap on engagement with said lug means; and (d) key means and keyway means disposed intermediate said side wall common to said flange means and the container for precluding rotation of the cap relative to the container, said key means and said keyway means being laterally displaceable relative to one another by flexing of said sidewall to effect disengagement of said key means from said keyway means and permit angular displacement of the cap relative to the container, said keyway means including at least one channel disposed upon the hollow neck section and extending parallel to the longitudinal axis of the hollow section and including an opening, said key means including at least a rib extending from said sidewall for engagement with said opening of one of said channels;

whereby, the cap may be removed from the container upon rotation of the cap relative to the container after disengagement of said rib with said channel.

2. The lock as set forth in claim 1 wherein the container includes two of said channels in opposed relationship to one another and said sidewall includes two of said ribs in opposed relationship to one another.

3. The lock as set forth in claim 2 wherein said hollow section includes four of said lug means located thereabout and the cap includes four of said flange means located within said sidewall for mating engagement with said four lug means.

4. The lock as set forth in claim 3 wherein said pair of channels are not in alignment with a line extending through any two of said four lug means.

5. A two phase lock for securing a cap to a container having a hollow section defining the mouth of the container, both the container and the cap being generally square shaped in cross-section and having corner edges, said lock comprising in combination:

(a) four lug means located upon the exterior surface of the hollow section;

(b) four flange means disposed within the cap for disengageably engaging said lug means upon angular displacement of the cap relative to the container; and (c) key means and keyway means disposed intermediate the cap and the container for precluding rotation of the cap relative to the container, said key means and said keyway means being laterally displaceable relative to one another to effort disengagement of said key means from said keyway means and permit angular displacement of the cap relative to the container, said keyway means including at least a pair of channels disposed upon the hollow section in opposed relationship to one another and disposed adjacent opposed ones of the corner edges of the container and out of alignment with a line extending through any two of said four lugs and said key means including at least two ribs in opposed relationship to one another and said pair of ribs being disposed adjacent opposed ones of the corner edges of the cap and extending from the cap for engagement with one of said channels, said channels extending parallel to the longitudinal axis of the hollow section and including an opening for receiving said ribs;

whereby, the cap may be removed from the container upon rotation of the cap relative to the container after disengagement of said key means with said keyway means.

6. A dispenser for dispensing cyanoacrylate, said dispenser comprising in combination:

(a) a container for housing the cyanoacrylate, said container including a hollow neck section defining the mouth of said container;

(b) a dispensing tip secured to the mouth of said container and defining a passageway for dispensing the cyanoacrylate from said container;

(c) a removable stopper for sealing said passageway;

(d) a cap for shielding said dispensing tip;

(e) lug means disposed about the hollow neck section of the container, said lug means being located upon and extending radially outwardly of the exterior surface of the hollow neck section;

(f) a flexible side wall formed as part of the cap for circumscribing the hollow neck section of the container;

(g) flange means disposed within said side wall for disengageably engaging said lug means upon angular displacement of the cap relative to the container, said flange means being located upon and extending radially inwardly of said side wall and positionally disposed upon said side wall to urge the lower edge of the cap against a shoulder of the container extending about the hollow neck section and impart a compressive force to the portion of the cap intermediate said flange means and the lower edge of the cap on engagement with said lug means; and (h) key means and keyway means disposed intermediate said side wall common to said flange means and the container for precluding rotation of the cap relative to the container, said key means and said keyway means being laterally displaceable relative to one another by flexing of said sidewall to effect disengagement of said key means from said keyway means and permit angular displacement of the cap relative to the container, said keyway means including at least one channel disposed upon the hollow neck section and extending parallel to the longitudinal axis of the hollow section and including an opening, said key means including at least a rib extending from said sidewall for engagement with said opening of one of said channels.

7. The dispenser as set forth in claim 6 wherein said container includes two of said channels in opposed relationship to one another and said sidewall includes two of said ribs in opposed relationship to one another.

8. The dispenser as set forth in claim 7 wherein said hollow section includes four of said lug means located thereabout and said cap includes four of said flange means located within said sidewall for mating engagement with said four lug means.

9. The dispenser as set forth in claim 8 wherein said pair of channels are not in alignment with a line extending through any two of said four lug means.

10. A dispenser for dispensing cyanoacrylate, said dispenser comprising in combination:

(a) a container for housing the cyanoacrylate, said container including an hollow section defining the mouth of said container and a shoulder about said hollow section, the container being generally square shaped in cross-section and having corner edges;

(b) a dispensing tip secured to the mouth of said container and defining a passageway for dispensing the cyanoacrylate from said container;

(c) a removable stopper for sealing said passageway;

(d) a cap for shielding said dispensing tip and including a lower edge for engaging the shoulder on locking of said cap, the cap being generally square shaped in cross-section and having corner edges; and (e) a two phase lock means for securing said cap to said container, said lock means comprising:

i. lug means disposed about the exterior surface of said hollow section of said container;

ii. flange means disposed within said cap for disengageably engaging said lug means upon angular displacement of said cap relative to said container; and iii. key means and keyway means disposed intermediate said cap and said container for precluding rotation of said cap relative to said container, said key means and said keyway means being laterally displaceable relative to one another to effect disengagement of said key means from said keyway means and permit angular displacement of said cap relative to said container, said keyway means including at least a pair of channels disposed upon said hollow section in opposed relationship to one another and disposed adjacent opposed ones of the corner edges of said container and out of alignment with a line extending through at least two of said lug means and said key means including at least two ribs in opposed relationship to one another and said pair of ribs being disposed adjacent opposed ones of the corner edges of the cap and extending from said cap for engagement with one of said channels, said channels extending parallel to the longitudinal axis of said hollow section and including an opening for receiving said ribs.

11. A two phase lock for securing a cap to a container having a hollow neck section defining the mouth of the container, both the container and the cap being generally square shaped in cross-section and having corner edges, said lock comprising in combination:

(a) lug means located upon the exterior surface of the hollow neck section;

(b) flange means disposed within the cap for disengageably engaging said lug means upon angular displacement of the cap relative to the container; and (c) key means and keyway means disposed intermediate the cap and the container for precluding rotation of the cap relative to the container, said key means and said keyway means being laterally displaceable relative to one another to effect disengagement of said key means from said keyway means and permit angular displacement of the cap relative to the container, said keyway means including at least a channel disposed upon the hollow neck section in opposed relationship to one of the corner edges of the container and out of alignment with a line extending through any two of said lug means and said key means including at least a rib disposed adjacent one of the corner edges of the cap and extending from the cap for engagement with one of said channels, each said channel extending parallel to the longitudinal axis of the hollow neck section and including an opening for receiving one of said ribs;

whereby, the cap may be removed from the container upon rotation of the cap relative to the container after disengagement of said key means with said keyway means.

12. A dispenser for dispensing cyanoacrylate, said dispenser comprising in combination:

(a) a container for housing the cyanoacrylate, said container including an hollow neck section defining the mouth of said container and a shoulder about said hollow neck section, the container being generally square shaped in cross-section and having corner edges;

(b) a dispensing tip secured to the mouth of said container and defining a passageway for dispensing the cyanoacrylate from said container;

(c) a removable stopper for sealing said passageway;

(d) a cap for shielding said dispensing tip and including a lower edge for engaging the shoulder on locking of said cap, the cap being generally square shaped in cross-section and having corner edges; and (e) a two phase lock means for securing said cap to said container, said lock means comprising:

i. lug means disposed about the exterior surface of said hollow neck section of said container;

ii. flange means disposed within said cap for disengageably engaging said lug means upon angular displacement of said cap relative to said container; and iii. key means and keyway means disposed intermediate said cap and said container for precluding rotation of said cap relative to said container, said key means and said keyway means being laterally displaceable relative to one another to effect disengagement of said key means from said keyway means and permit angular displacement of said cap relative to said container, said keyway means including at least a channel disposed upon said hollow neck section in opposed relationship to one of the corner edges of said container and out of alignment with a line extending through any two of said lug means and said key means including at least a rib disposed adjacent one of the corner edges of the cap and extending from said cap for engagement with one of said channels, each said channel extending parallel to the longitudinal axis of said hollow neck section and including an opening for receiving one of said ribs.

* * * * *